United States Patent [19]

Arcangeli

[11] Patent Number: 4,532,776

[45] Date of Patent: Aug. 6, 1985

[54] HIGH EFFICIENCY ICE MAKING MACHINE AND FAIL SAFE MECHANISM THEREFOR

[76] Inventor: Henio R. Arcangeli, 2406 30th St., Santa Monica, Calif. 90405

[21] Appl. No.: 437,531

[22] Filed: Oct. 29, 1982

[51] Int. Cl.[3] ..... F25C 1/14

[52] U.S. Cl. ..... 62/354; 200/61.2; 340/612

[58] Field of Search ..... 62/354; 141/198, 218; 53/503; 340/612, 614, 616; 200/61.21, 61.2; 222/64

[56] References Cited

U.S. PATENT DOCUMENTS

| | | | |
|---|---|---|---|
| 3,049,895 | 8/1962 | Larson et al. | 62/354 |
| 3,059,450 | 10/1962 | Mueller et al. | 62/354 X |
| 3,196,624 | 7/1965 | Reynolds | 62/354 X |
| 3,238,739 | 3/1966 | Ross | 62/354 X |
| 3,238,740 | 3/1966 | Ross | 62/354 |
| 3,274,792 | 9/1966 | Weil et al. | 62/354 X |
| 3,290,895 | 12/1966 | Schneider et al. | 62/354 X |

FOREIGN PATENT DOCUMENTS

| | | | |
|---|---|---|---|
| 239468 | 5/1967 | U.S.S.R. | 222/64 |

*Primary Examiner*—William E. Tapolcai

*Attorney, Agent, or Firm*—Beehler, Pavitt, Siegemund, Jagger & Martella

[57] ABSTRACT

An improved flake ice making machine is disclosed wherein flake ice is broken away from a submerged refrigerated surface by a rotating auger. A tank surface opposite the refrigerated surface has screw thread guides affixed to it which cooperate with the rotating auger to lift ice flakes over the tank wall and into an ice receiving channel encircling the tank wall. A sweeper arm rotates with the auger and sweeps the ice in the channel towards a discharge opening. Pressure sensitive switch means are connected for stopping rotation of the auger in response to an excessive accumulation of ice in the event of blockage of the discharge opening. The auger is supported only to a drive shaft extending through the evaporator so that there are no submerged bearings or bearing surfaces.

16 Claims, 5 Drawing Figures

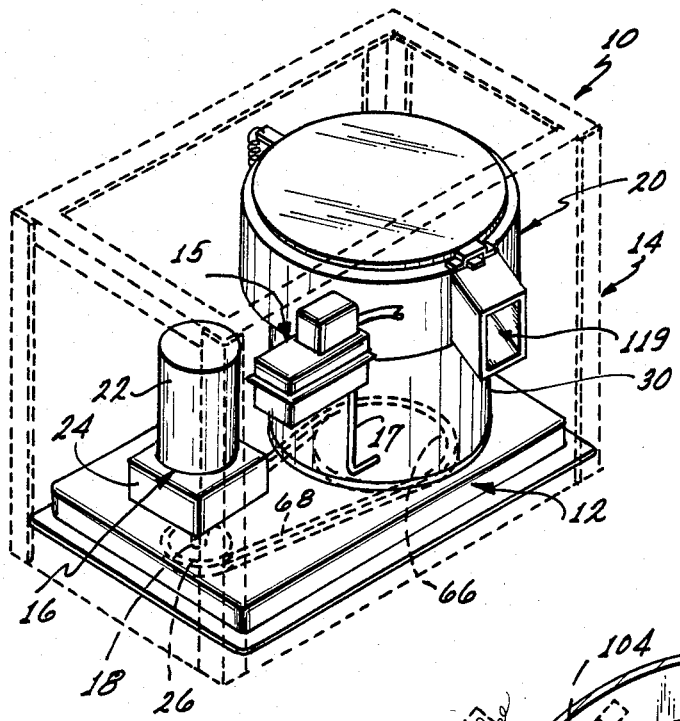
Fig. 1
Fig. 3
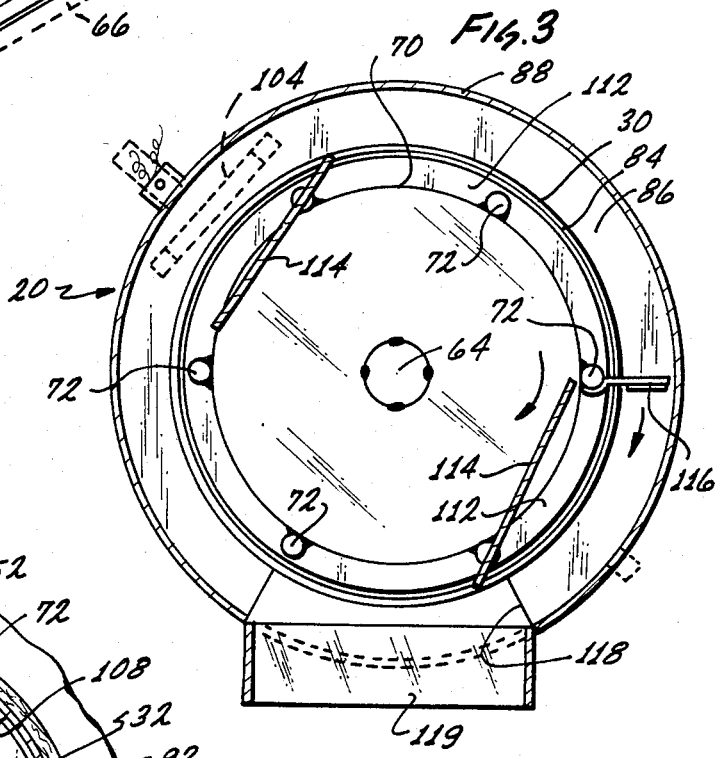
Fig. 4
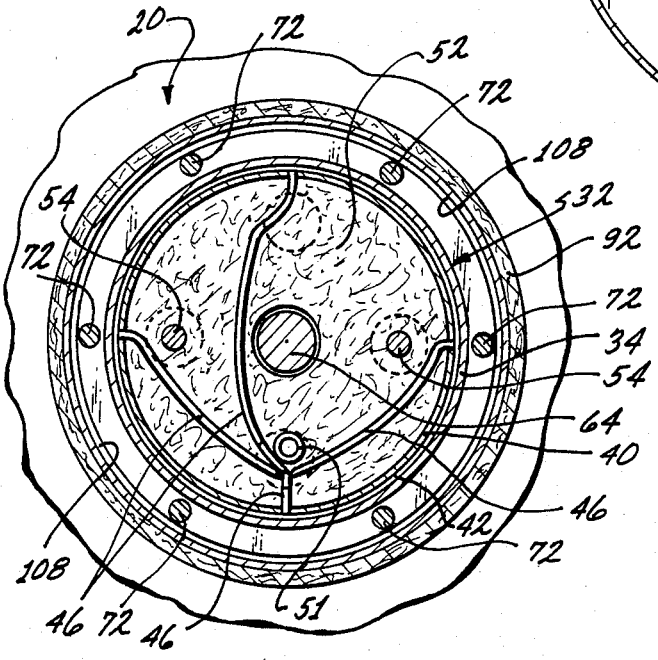

HIGH EFFICIENCY ICE MAKING MACHINE AND FAIL SAFE MECHANISM THEREFOR

BACKGROUND OF THE INVENTION

1. Field of the Invention

The present invention pertains to the field of refrigeration apparatus and is more particularly directed to a high efficiency ice making machine having an improved ice harvesting mechanism including a fail safe mechanism to prevent minimize inconvenience and down time due to blockage of the ice delivery opening and consequent accumulation of ice within the harvesting mechanism.

2. State of the Prior Art

Various designs for ice making machines are known as exemplified by the following patents:

| U.S. Pat. No. | Patentee | Issue date |
|---|---|---|
| 3,921,415 | Kattis | November 25, 1975 |
| 3,159,010 | Kattis | December 1, 1964 |
| 3,320,769 | Ross | May 23, 1967 |
| 2,575,374 | Walsh | November 20, 1951 |
| 3,620,040 | Clearman et al | November 16, 1971 |
| 3,797,271 | Wanson | March 19, 1974 |

Also known to the applicant and relevant to the drive mechanism of the present invention are:

| | | |
|---|---|---|
| 2,199,038 | Brix-Hansen | April 30, 1940 |
| 1,954,518 | Downer | April 10, 1934 |

In general, the Kattis and Ross ice making machines disclosed by the above referenced patents include an evaporator assembly surrounded by a tank connected to a water supply conduit. A liquified refrigerant gas is supplied to the interior of the evaporator where it is allowed to evaporate and absorb heat from the water surrounding the evaporator. A layer of ice thus forms on the outer surface of the evaporator. An auger or mechanical scraper is mounted for rotation about the evaporator and spaced from its outer surface such that when the layer of ice attains a given thickness the auger breaks off the ice in the form of cracked or flake ice which tends to float within the water tank. Various mechanisms are provided for harvesting the ice, that is, collecting the ice broken away from the evaporator surface and delivering it to the exterior of the ice making machine. The harvesting mechanisms in the ice making machines of the prior art suffer from a common shortcoming in that the ice is pushed against gravity along an upwardly sloping ramp, rising from the water tank and terminating in a chute through which the ice is delivered into a hopper or suitable container. The machines of the prior art thus rely on the pressure exerted by accumulation of freshly made ice to push previously formed ice up the ramp chute and out of the machine.

It is well known that fragments of ice are readily cemented together into a hard solid mass when the fragments are pressed together. Thus it is critical in an effective ice making machine to minimize the handling of large quantities of ice which through its own weight will have a tendency to stick together in a cohesive mass, or to push or otherwise exert pressure on any substantial quantity of ice. This has a tendency of compacting the ice and if the delivery chute becomes blocked for any reason, the harvesting mechanism continues to operate, compacting the ice at ever increasing pressures until the system jams completely and ceases to operate. The pressures exerted by the ice can be such as to snap off the drive shaft which rotates the auger or to break some other portion of the mechanism, requiring extensive and costly repairs. Even if no mechanical damage is sustained by the device, the accumulation of compacted ice requires that the ice making machine be defrosted and the accumulated ice melted before operation can resume. This deicing may require several hours of idle machine time.

SUMMARY OF THE INVENTION

The present invention improves over the prior art by providing a high efficiency ice making machine of more efficient and reliable operation than has been known in the past without sacrifice in simplicity or economy of construction. The flake ice harvested from the evaporator wall is handled by a novel harvesting and delivery mechanism characterized by its gentle handling of the flake ice to minimize the likelyhood of jamming. The novel ice making machine is also provided with a fail safe mechanism which stops the ice harvesting mechanism upon detecting an incipient blockage of the delivery mechanism so as to avoid jamming the ice making machine with compacted ice which is difficult to dislodge and requires prolonged de-icing before the machine can be put into operation again. Preferably, the auger drive shaft of the invented machine is supported by bearings which are not immersed in water, as has been the practice by some manufacturers. Such immersion of the drive shaft bearings has resulted in early failure of the bearings and contamination of the ice with debris produced by friction and erosion of the bearings.

The improved ice making machine according to this invention comprises a water tank including a refrigerated evaporator wall and a tank wall terminating in an upper rim. An auger assembly is mounted for rotation relative to the evaporator for breaking away ice flakes from the ice layer forming on the evaporator wall. The auger may be driven by an electric motor coupled to the auger through a reduction gear drive. The auger is spaced from the outer surface of the evaporator to provide a given clearance such that when a layer of ice having a thickness in excess of this distance is formed the auger breaks the ice away from the evaporator surface. Flake ice disloged from the evaporator surface is carried in a circular path by the auger. One or more helical flanges extend inwardly from the cylindrical wall of the water tank and twist upwardly in the direction of rotation of the auger. The cracked ice is raised by cooperation between the flanges and the rotating auger to the level of the upper rim of the water tank wall. The flanges in effect operate as screw threads which lift the flake ice accumulating between the auger and the water tank wall. The flake ice is received in an outer ice collecting channel encircling the water tank wall. A sweeper arm mounted to the auger sweeps the ice along the outer channel towards a discharge opening formed in the channel from which the ice is free to fall into a hopper or the like.

Desirably, one or more deflector plates are provided for directing the rising ice flakes over the upper rim of the tank wall and into the ice collecting channel as the rising ice also moves in a circular path with the rotating auger.

In a preferred embodiment of the invention, a cover is disposed above the water tank and the ice collecting channel and a pressure sensing switch is connected for cutting off power to the drive motor which rotates the auger, such that if the chute opening becomes blocked, the pressure sensing switch will be tripped by movement of the cover caused by a relatively small accumulation of ice in the peripheral channel or about the auger, thus interrupting further harvesting of ice. This prevents the formation of a compacted means of ice in the channel and about the auger. The pressure sensitive switch may also be connected, through a suitable power relay for cutting off the compressor normally associated with ice making machines for liquifying the refrigerant gas.

Desirably, the auger is driven by means of a drive shaft extending axially through the evaporator cylinder, and journalled to at least an upper bearing and a lower bearing. Both bearings are enclosed within the evaporator cylinder and never come into contact with water. The upper bearing is disposed, within the evaporator above the normal water level in the water tank and is further protected against moisture and humidity by a shaft seal. The lower bearing is disposed near the bottom of the evaporator and outside of the water tank.

These and other characteristics of the present invention are better understood by reviewing the following figures, which are submitted for the purposes of illustration only and not limitation, wherein like elements are referenced by like numerals, in light of the detailed description of the preferred embodiment.

BRIEF DESCRIPTION OF THE DRAWINGS

FIG. 1 is a perspective view of an ice making machine constructed according to the present invention.

FIG. 3 is a horizontal section taken along line 3—3 in FIG. 2.

FIG. 4 is a horizontal section taken along line 4—4 in FIG. 2.

DETAILED DESCRIPTION OF A PREFERRED EMBODIMENT OF THE INVENTION

Figure 2:
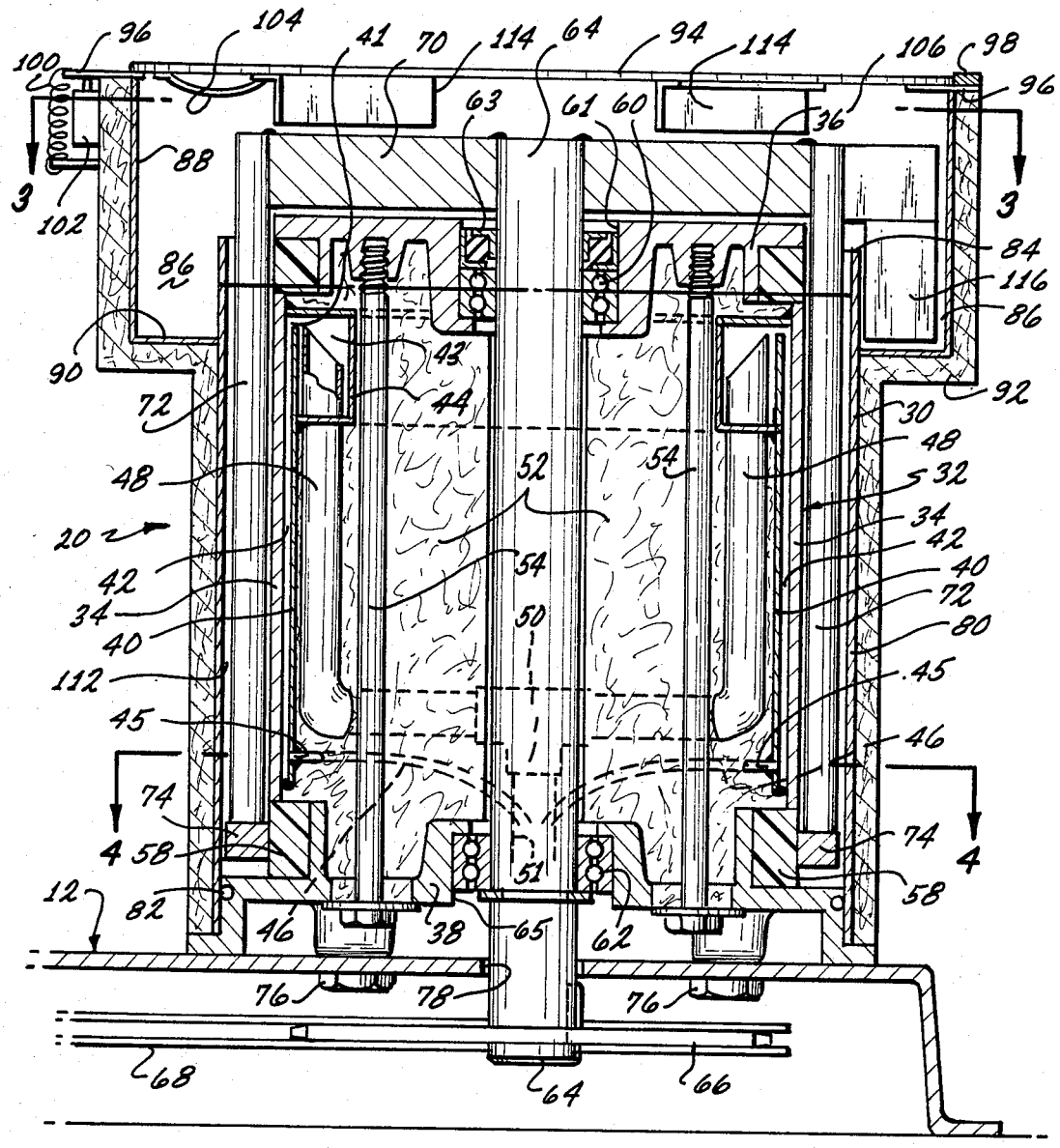
FIG. 2 is a vertical cross section of the evaporator and ice harvesting mechanism of the machine of FIG. 1.

With reference to the drawings and FIG. 1 in particular, an ice making machine 10 is shown which comprises a base 12 to which is affixed a rectangular frame 14 for supporting a suitable enclosure, not shown in the drawings. Mounted to the base 12 is a gear motor drive 16 and a evaporator-ice harvesting mechanism assembly 20. The gear motor drive 16 may be an electrically driven motor 22 coupled to a reduction gear drive 24 having an output shaft 18. The base 12 may be constructed of sheet metal of sufficient gage for rigidly supporting the motor drive and ice making assembly. The output shaft 18 of the gear motor drive extends downwardly through the base 12 and has a driving pulley 26 affixed to its lower end.

The construction of the evaporator and ice harvesting assembly 20 will be better understood by reference to the sections of FIGS. 2, 3 and 4. The assembly 20 comprises a cylindrical evaporator structure 32 which includes a cylindrical evaporator wall 34, a top 36, and a bottom 38. An inner cylindrical wall 40 which defines with the outer evaporator wall 34 a narrow annular evaporation space 42 is joined at its lower end to the evaporator wall 34 along its entire circumference in a gas tight seal. The inner wall 40 terminates short of the evaporator top 36 so that the evaporation space is closed at the bottom but has a circumferential slot 41 at its upper end opening into an annular space 43 defined by a hollow collector ring 44. Liquified refrigerant is introduced by means of inlet tubes 46 into the evaporation space 42 at the lower end thereof through inlet ports 45 spaced around the bottom of the evaporation space. The liquified gas upon entering the evaporation space passes to the gaseous stage, absorbing heat from the environment and thus causing a temperature drop in the evaporator wall 34, which is desirably made of a high thermal conductivity metal alloy. The refrigerant gas rises through the evaporation space 42 and enters the collector annulus 43, and flows out of the evaporator through suction tubes 48 which extend downwardly through the interior of the evaporator. The tubes 48 connect at a joint 50 to a single suction tube 51 which emerges through the bottom 38 of the evaporator and is connected to a compressor which liquifies the refrigerant in a condenser unit and pumps it back into the evaporation space through inlet tubes 46. The space enclosed by the evaporator walls 34, 40 and the hollow ring 44 is air tight so as to prevent leakage of refrigerant gas, and the inlet and suction tubes 46 and 48 respectively are sealed to the evaporator walls at their points of entry, as by brazing. The interior space of the evaporator enclosed by the interior wall 40 may be filled with a suitable insulating material 52 such as urethane foam.

Figure 5:
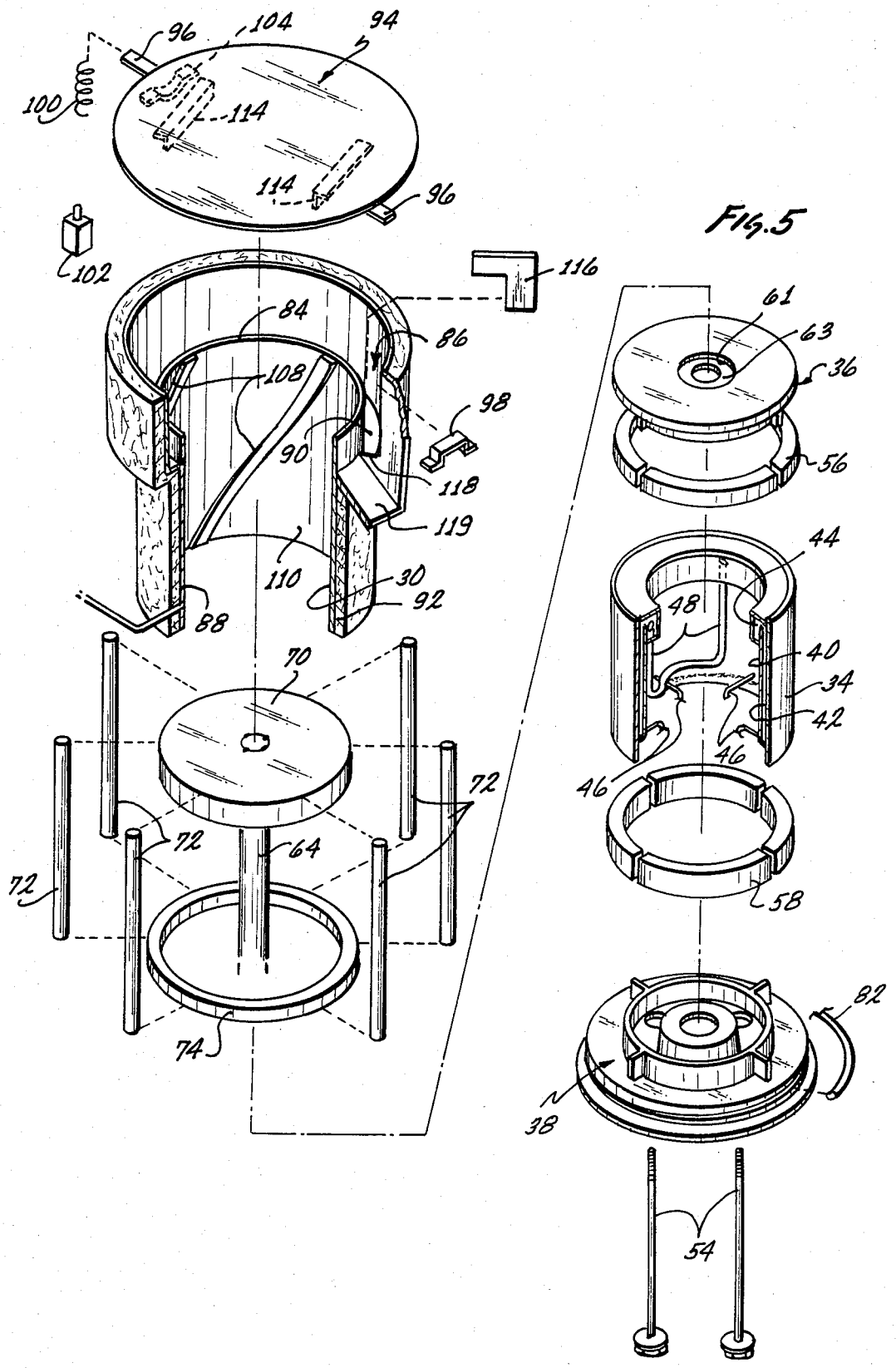
FIG. 5 is an exploded view of the evaporator and ice harvesting mechanism of FIG. 2.

The top 36 and bottom 38 of the evaporator assembly may be held together by means of bolts 54 so as to hold the evaporator walls 34 and 40 in compression between the top and bottom, as may be better appreciated from the exploded view of FIG. 5. The bottom 38 of the evaporator assembly in turn is securely bolted to the base 12 by means of bolts 76 extending upwardly from the underside of the base 12 into mating threaded bores formed in the bottom 38.

The top 36 and bottom 38 of the evaporator may be made of metal and are insulated from the metallic evaporator walls 34 and 40 and collector ring 44 by means of insulating ring 56 at the top and insulating ring 58 at the bottom, respectively. The insulating rings may be made of nylon or other thermally insulating substance.

A pair of shaft bearings 60, 62 are mounted to the top and bottom pieces 36 and 38 respectively of the evaporator assembly for journaling an auger drive shaft 64. The drive shaft may be connected to the gear motor 16 in a variety of ways. In a presently preferred embodiment, the lower end of the drive shaft 64 extends through an opening 78 in the base 12 and has mounted thereto a driven gear or sprocket 66 connected by a drive chain 68 to a driving sprocket 26 affixed to the output shaft of the gear motor 16. The gear motor and chain drive preferably are such as to rotate the auger drive shaft 64 at approximately 12 revolutions per minute. If desired, the gear motor 16 may be repositioned and the output shaft 18 coupled directly to either the upper end or the lower end of the auger drive shaft, thus eliminating the chain drive.

The upper end of the auger drive shaft 64 has affixed thereto an auger disc 70. A number of auger bars 72, which may be of cylindrical cross section, are affixed to the circumference of the auger disc 70 as by welding thereto so as to extend vertically in a direction parallel to the drive shaft 64. In the alterative, the auger bars may be slanted rather than vertical. The lower ends of the auger bars 72 are affixed to a reinforcing ring 74 which interconnects and supports the lower ends of the auger bars against lateral pressure exerted by the ice during operation of the machine. Desirably the entire auger assembly including the drive shaft 64, disc 70, auger bars 72, and supporting ring 74, are made of a strong rigid material such as a stainless steel alloy, with the various component parts welded together to form a strong, rigid, corrosion and water resistant assembly. The reinforcing ring 74 which forms the lower end of the auger structure encompasses the insulating ring 58, but does not bear against it so that there is no direct frictional contact between the rotating auger and the evaporator structure, thus avoiding problems which plaged the devices of the prior art, due to wear and abrasion between the auger and the evaporator structure. Reliance is placed instead on the rigidity of the auger structure and the support provided by the two bearings 60 and 62 which alone support the drive shaft 64.

The auger drive shaft 64 as best seen in FIG. 2 extends coaxially through the evaporator cylinder 32. The auger bearings are mounted axially to the evaporator cylinder. The upper bearing 60 is supported in a central recess 61 defined in the top piece 36 of the evaporator, and is sealed against moisture by an annular seal 63 fitting snuggly around the auger shaft 64 within the recess 61 so as to cover and protect the bearing 60. The seal may be a commercially available neoprene seal having inner and outer diameters corresponding to the shaft and recess diameters respectively. The top of the bearing recess is above the normal water level in the water tank surrounding the evaporator, consequently the top bearing 60 is never submerged. The seal 63 is provided to protect against moisture condensing on the auger shaft and to prevent such condensation from trickling down from the exposed auger end of the auger shaft. The lower bearing 62 is mounted in a recess 65 formed in the bottom of the evaporator and outside the water tank and is thus removed from any contact with water or ice. The bearings are packed in lubricant grease to further protect against moisture.

Surrounding the evaporator assembly is a cylindrical tank wall 80 which makes a water tight seal at its lower end with the evaporator bottom 38 to form a water tank 112. The seal may be secured by means of a resilient O-ring 82 disposed in a radial groove formed in the periphery of the circular bottom 38 so as to make sealing engagement with the cylindrical tank wall 80. A float and tank assembly 15, shown in FIG. 1, is connected to a source of water and includes a water supply conduit 17 connected to the water tank for holding substantially constant the water level in the water tank 112.

The tank wall terminates in an upper rim 84 which desirably is lower than the upper end of the auger structure. An ice collecting channel 86 is defined about the tank wall by a cylindrical channel wall 88 and a channel floor 90 which projects radially outwardly from the tank wall 80 below the upper rim 84 and is joined to the channel wall 88. The outer surfaces of the water tank and ice collecting channel structures desirably are thermally insulated with a layer 92 of a suitable material such as foam rubber, urethane foam, or the equivalent.

The ice flakes broken away from the evaporator wall accumulate in a loose slurry in the water tank 112 between the auger bars 72 and follow the auger in its circular motion about the evaporator cylinder. A number of helical flanges 108 are formed on the interior surface of the tank wall 80 such as by metal strips welded to the tank wall. The helical flanges 108 twist upwardly in the direction of rotation of the auger and each may have a pitch such as to rise the full height of the water tank wall 80 to the upper rim 84 in an arc of ninety degrees of the water tank circumference. Four such flanges 108 may be spaced at ninety degree intervals along the interior water tank wall surface 110. The radial width of the water tank is substantially equal to the sum of the clearance between the auger bars and the evaporator surface, the diameter of the auger bars 72, and the width of the helical flanges 108 extending from the tank wall. The auger bars are thus so closely spaced to the inner surface 110 of the tank wall 30 that a portion of the accumulating flake ice is continuously forced upwardly along flanges 108 in the space between the tank wall 30 and the rotating auger bars 72. The flanges 108 in effect act as screw threads, each flange defining an upwardly rising ramp surface along which the flake ice is pushed by the revolving auger assembly. The flake ice thus rises to the end of the flanges 108 at the tank rim 84 and is pushed above the level of the upper rim 84 of the water tank by flake ice rising underneath from lower levels of the water tank. Desirably, the evaporator cylinder 32 rises above the upper rim 84 to just below the auger disc 70, so as to block the rising flake ice against falling in a radially inward direction. To further encourage the flake ice to fall radially outwardly over the rim 84 into the ice collecting channel 86, a pair of deflector plates 114 are mounted such that the flake ice rising above the rim 84 is deflected radially outwardly over the rim 84 upon making contact with the deflector plates during its circular trajectory about the evaporator. The generally tangential disposition of the deflector plates to the circular path followed by ice rising above the circular rim 84 may be best appreciated by reference to FIGS. 2 and 3 wherein the plane of each plate 114 is seen to extend downwardly from the lid 94 and to traverse at an angle the path of the revolving ice such that as the rising ice moves in its circular pattern indicated by the arrow in FIG. 3 and rises above the level of the auger disc 70 it is deflected radially outwardly and drops into the peripheral channel 86 under the influence of gravity. At least one sweeper arm 116 extends into the channel 86 and is affixed to auger such that it is carried in a continuous circular motion and sweeps the flake ice along the floor of the channel 86. The sweeper arm may be fashioned out of sheet metal and shaped so as to substantially conform to the radial cross section of the channel 86, as shown in FIG. 2. As the auger rotates the ice within the channel 86 is swept in a circular path towards a discharge opening 118 and a chute 119 defined in the floor 90 of the channel 86. The chute 119 is fashioned in such a manner that the ice swept ahead of the sweeper arm 116 falls through a discharge opening 118 out of the channel 86 through the chute 119 and into a suitable container where the ice is stored. The novel ice harvesting mechanism of this invention produces higher quality ice than previous machines because water is drained from the flake ice as it is lifted over the upper rim of the water tank.

The upper rim of the cylindrical channel wall 88 supports a cover 94 which is substantially secured against lateral displacement relative to the tank wall by means of two diametrically opposed tabs 96, one of which fits into a bracket 98 affixed to channel wall 88. The other tab 96 is retained by a spring 100 which is affixed at its lower end to the channel wall 88. An electrical switch 102 is mounted to the exterior of the channel wall such that it is kept depressed in an electrically open condition by the tab 96 under the urging of the spring 100. The switch 102 is electrically connected for activating a lockout power relay so as to interrupt electrical power to the gear motor 16 and the refrigerant compressor in the event that the switch 102 is closed, which occurs upon raising the cover 94 on the side of the spring loaded tab 96. The lockout relay may be of the type which is manually reset by first shutting off power and then restoring power to the circuit.

The cover 94 may be provided with a downwardly extending portion 104 secured to the underside of the cover 94 in the vicinity of the tab 96 and switch 102 in order to improve the sensitivity of the anti-jamming power cut off system. The portion 104 may be a bowed strip of sheet metal, but its precise nature or dimensions are not critical. The element 104 is dimensioned and positioned such that it is the first portion of the lid to make contact with a non-yielding mass of ice accumulating around the auger structure and within the peripheral channel 86. The accumulating ice pushes upwardly on the portion 104, thus raising the lid 94 on the side of the tab 96, causing the electrical switch 102 to close and trigger a lockout relay to interrupt power to the gear motor 16 and compressor so as to bring the auger to a stop. This prevents the further accumulation and compacting of ice at the top of the auger and in the channel 86 and also halts the formation of more ice in the water tank.

Thus, the purpose of the element 104 is to provide advance sensing of an accumulation of ice before the head space 106 above the auger and the channel 86 has been completely filled with ice before the switch 102 is tripped. Such advance sensing makes it considerably easier to clear ice accumulations within the ice receiving channel 88 so as to allow ready resumption of operation without undue delay. Any blockage may be quickly cleared by lifting the cover 94 and manually removing the ice from inside the inactive machine. The cover is then replaced and the cut off relay is reset to resume normal operation.

The ice harvesting process thus consists of breaking off flakes of ice forming on the evaporator wall 34 by means of the rotating auger bars 72 and lifting the resulting ice flakes out of the water tank by means of screw thread guiding flanges affixed to the interior surface of the water tank wall 30. In operation of the machine, ice flakes rise continuously along the the thread flanges 108, and if several, e.g. four such flanges are provided as shown in FIG. 5, flake ice rises substantially along the entire inner surface of the tank wall and tends to rise above the upper rim along its entire circumference in a rotating crown-like formation encircling the auger disc 70. As this ice structure advances against the deflector plates it readily crumbles and drops in small, loosely connected flake clusters into the collecting channel 86.

It will be appreciated that the handling of the ice by the harvesting mechanism is such that at no point in the harvesting process is there any substantial compaction of flake ice. The speed of rotation of the auger is selected to be such that the flake ice within the water tank 112 does not accumulate beyond a relatively loose and fluid slurry which is readily lifted along the flanges 108 over the rim 84 and into the channel 86. The ice flakes are lifted along the flanges as it is carried along by the revolving auger, and not by other ice behind it. Sufficient auger bar, e.g. six evenly spaced bars, are provided such that each bar pushes a relatively small quantity of ice in its circular trajectory and several, e.g. 4, helical guide flanges are spaced about the tank wall so that flake ice rises continuously along most of the circumference of the water tank rim 84, in order to avoid compressing large masses of flake ice. Any small degree of compression which may occur during the lifting of the flake ice is counteracted by the deflector plates which break up the ice into small clusters of ice flakes. In addition, the speed of revolution of the auger and consequently, that of the sweeper arm is relatively high, e.g. 12 r.p.m., such that ice in the collecting channel is frequently and rapidly swept out through the discharge opening 118 and does not accumulate. Further the floor 90 of the collecting channel 86 is preferably smooth and level, so that the ice swept therealong slides very easily and does not tend to pile up due to either friction or gravity. Thus, there is no opportunity for flake ice to be compacted into a solid mass as has been the case in the machines of the prior art. By causing the flake ice to rise along a large portion of the water tank circumference and fall freely into an open collecting channel it is possible to harvest a relatively large quantity of ice in a continuous process, yet without handling large masses of ice at one time anywhere within the machine, as was common practice in the devices of the prior art where the entire ice output of the ice maker is forced under pressure and against gravity up an inclined ramp and through the restricted opening of a chute.

It must be understood that many alterations and modifications may be made by those having ordinary skill in the art to the structure described herein without departing from the spirit and scope of the invention. Therefore, the presently illustrated embodiment has been shown only by way of example and for the purpose of clarity and should not be taken to limit the scope of the following claims.

I claim:

1. An ice making machine comprising:

a water tank including a refrigerated wall and a water tank wall terminating in a circular upper rim;

auger means rotatable relative to said refrigerated wall for breaking off flakes of ice from a layer of ice forming on said refrigerated wall;

means cooperating with said rotatable auger for raising flake ice out of said water tank;

overlying said upper rim so as to allow the flake ice to rise above said rim and form a structure of flake ice rotating in said headspace with said auger;

ice collecting means disposed exteriorly of said water tank and below said rim;

stationary deflector means disposed generally tangentially across the path of said moving flake ice structure for breaking up the circularly moving structure breaks up on contact with the deflector means into relatively small ice flake clusters which are deflected over said rim and into said collecting means; and sweeper means rotatable with said auger means for sweeping flake ice out of said ice collecting means through a discharge opening formed in the ice collecting means.

2. The machine of claim 1 wherein said means cooperating with said rotating auger comprise guide means adjacent to said rotatable auger such that flake ice in said water tank moves with said auger in a circular path and rises along said guide means toward said upper rim.

3. The machine of claim 2 wherein said rotatable auger comprises a plurality of auger bars spaced about said evaporator.

4. The machine of claim 2 wherein said guide means comprise upwardly twisting helical flanges extending from said tank wall.

5. The machine of claim 2 wherein said water tank wall is cylindrical and said refrigerated wall is a cylinder coaxial with said evaporated wall; and the radial width of said water tank is substantially equal to the sum of the radial dimensions of said guide means, said auger means, and the clearance between said auger and said evaporator.

6. The machine of claim 1 wherein said ice collecting means comprise a channel formed along said water tank wall.

7. The machine of claim 6 further comprising a discharge opening defined in said channel and sweeper means movable along said channel for sweeping ice collected in said channel towards said discharge opening.

8. The machine in claim 7 wherein said sweeper means comprises one or more sweeper arms extending into said channel and mounted for rotation with said auger means.

9. The machine of claim 1 further comprising auger drive means and refrigerant compressor means, and cut off means operative for stopping said one or both of said auger drive means and compressor means responsive to excessive accumulation of flake ice in said ice collecting means or said water tank.

10. The machine of claim 9 wherein said auger drive means includes an electric motor and said drive cut off means comprise pressure sensitive switch means connected for interrupting electrical power to said electric motor upon sensing an excessive accumulation of ice.

11. The machine of claim 10 where said pressure sensitive switch means comprise a cover overlying said ice collecting means and said water tank and cooperating with said switch means for interrupting power when said cover is raised by an accumulation of flake ice.

12. The machine of claim 1 wherein said tank wall is annular, the lower ends of said tank wall and said evaporator wall being connected to form a tank bottom, and said evaporator wall is part of an evaporator cylinder assembly mounted coaxially within said water tank, and further comprising an auger drive shaft journalled to said evaporator and coaxial therewith, said auger being affixed to the upper end of said drive shaft above said evaporator, said auger comprising an auger disc and a plurality of downwardly extending auger bars spaced about the circumference of said evaporator and affixed to said auger disc, said drive shaft being supported by one or more bearings axially mounted to said evaporator, such that there are no bearings or bearing surfaces submerged in said water tank.

13. An ice making machine comprising an evaporator having an upper end, an auger mounted for rotation about said evaporator and spaced therefrom for breaking away ice flakes, drive means for rotating said auger about said evaporator a water tank including a bottom and a cylindrical tank wall surrounding said auger, said tank wall terminating in a circular upper rim below the upper end of the evaporator;

ice collector channel means disposed about said water tank and below said upper rim;

a plurality of helical guides on said tank wall cooperating with said auger means for raising flake ice out of said water tank into a headspace overlying said circular upper rim such that flake ice rises above said rim into said headspace and is carried in a circular path with said auger;

a plurality of stationary deflector surfaces spaced along said rim and disposed above the upper end of the evaporator in said headspace generally tangentially to and across the path of said circularly moving flake ice for breaking up the rising ice and deflecting the broken up flake ice outwardly over said rim into said channel means;

at least one discharge opening in said channel means; and sweeper means for sweeping flake ice out of said channel means through said least one discharge opening.

14. The device of claim 13 wherein said drive means comprise a drive shaft extending through said evaporator, said drive shaft being journalled and supported by at least an upper bearing and a lower bearing, said upper bearing being mounted to the upper end of said evaporator above the normal water level in said water tank and said lower bearing being disposed underneath said bottom such that neither bearing is normally submerged in water in said water tank.

15. The device of claim 13 wherein said drive means comprise motor means connected for driving said drive shaft, and pressure sensing cut off switch means overlying said water tank and connected for interrupting power to said motor means such that the harvesting of further ice flakes is interrupted upon sensing an excessive ice accumulation within said water tank to thereby facilitate easy clearing of such accumulated ice.

16. The machine of claim 13 wherein the improvements further comprise deflector means for deflecting flake ice rising over said upper rim into said ice collecting channel.

* * * * *